US007897890B2

(12) United States Patent
Kikukawa et al.

(10) Patent No.: US 7,897,890 B2
(45) Date of Patent: Mar. 1, 2011

(54) VACUUM INSULATED SWITCHGEAR

(75) Inventors: Shuichi Kikukawa, Hitachi (JP); Kenji Tsuchiya, Hitachi (JP); Yuko Kajiyama, Hitachiota (JP)

(73) Assignee: Hitachi, Ltd., Tokyo (JP)

( * ) Notice: Subject to any disclaimer, the term of this patent is extended or adjusted under 35 U.S.C. 154(b) by 639 days.

(21) Appl. No.: 11/841,159

(22) Filed: Aug. 20, 2007

(65) Prior Publication Data

US 2008/0067152 A1 Mar. 20, 2008

(30) Foreign Application Priority Data

Sep. 20, 2006 (JP) ..... 2006-253895

(51) Int. Cl.
*H01H 33/66* (2006.01)

(52) U.S. Cl. ..... 218/140; 218/7; 218/120; 218/153

(58) Field of Classification Search ..... 218/7, 10, 218/14, 118, 120, 140, 153, 154
See application file for complete search history.

(56) References Cited

U.S. PATENT DOCUMENTS

| | | | | |
|---|---|---|---|---|
| 6,188,034 | B1 | 2/2001 | Tsuzura et al. | |
| 6,362,445 | B1 * | 3/2002 | Marchand et al. | 218/155 |
| 6,510,046 | B2 * | 1/2003 | Arioka et al. | 361/612 |
| 7,425,687 | B2 * | 9/2008 | Morita et al. | 218/120 |
| 2007/0228014 | A1 | 10/2007 | Tsuchiya et al. | |

FOREIGN PATENT DOCUMENTS

| | | | |
|---|---|---|---|
| EP | 1047169 A2 * | 10/2000 | 218/118 |
| JP | 2000-306474 | 11/2000 | |
| JP | 2004-282907 | 10/2004 | |
| JP | 2006-059557 | 3/2006 | |
| JP | 2006-238522 | 9/2006 | |

OTHER PUBLICATIONS

Final Office Action in corresponding Chinese Application No. 2007101418946 mailed Sep. 20, 2010 (with partial English translation).
Office Action in corresponding Chinese Application No. 2007101418946 mailed Aug. 28, 2009 (with partial English translation).
Office Action in corresponding Korean Application No. 2007-82904 mailed Sep. 24, 2010 (with partial English translation).

* cited by examiner

*Primary Examiner* — Renee Luebke
*Assistant Examiner* — Marina Fishman
(74) *Attorney, Agent, or Firm* — Brundidge & Stanger, P.C.

(57) ABSTRACT

A vacuum insulated switchgear is provided with: an enclosure having a switch block defined by a grounded metal plate, a bus block positioned above the switch block, and a cable block positioned on the rear side of the bus block; a bus provided in the bus block and connected with a fixed contact of a vacuum double-break three-position switch; the vacuum double-break three-position switch provided in the switch block so that its movable contacts are positioned below its fixed contacts; an operating device provided in the switch block so as to be positioned below the vacuum double-break three-position switch; and a lever mechanism that couples together the movable contacts of the vacuum double-break three-position switch and the operating device.

11 Claims, 11 Drawing Sheets

VACUUM INSULATED SWITCHGEAR

CLAIM OF PRIORITY

The present application claims priority from Japanese application Serial No. 2006-253895, filed on Sep. 20, 2006, the content of which is hereby incorporated by reference into this application.

FIELD OF THE INVENTION

The present invention relates to a vacuum insulated switchgear and in particular to a vacuum insulated switchgear suitably used in receiving and transforming equipment.

BACKGROUND OF THE INVENTION

In power receiving and transforming equipment, there is installed a closed switchboard (referred to as a switchgear). It is constructed by housing the following items in an enclosure; a vacuum circuit breaker for interrupting a load current or a fault current; a disconnector and an earthing switch for ensuring the safety of a worker who conducts maintenance work on a load; detectors for system voltage and current; a protective relay; and the like.

With respect to this type of switchgear, it is required to give consideration to the position and direction of power cables connecting the switchgear. Therefore, it has been desired that the switchgear can cope with the position and direction of the power cables.

In one of measures for the improvement of this regard, various positions and directions of power cables cope with each other as follows. Multiple switches are housed in respective vacuum cases and integrally molded; this molded portion is provided with terminals for power cable connection; and these terminals for power cable connection are protruded in various directions. (Refer to Patent Document 1, for example.)

[Patent Document 1] JP-A-2000-306474 (FIG. 16)

The above-mentioned switchgear is so constructed that the following can be implemented with respect to multiple switches, buses, terminals for power cable connection, and the like housed in an enclosure having a door: the disposition of them in the enclosure can be changed to cope with various positions and directions of power cables.

With respect to power receiving and transforming equipment having this type of switchgear, users' demands have been diversified. An example will be taken. The type of load and operating conditions differ depending on the purpose of use on the customers' sites. When a distribution system is planned, therefore, consideration is given to the requirements for safety, reliability, the maintenance of operation, and expected increase in load. In this planning for power distribution, it is also required to take the following into account: control of a circuit breaker, a disconnector, an earthing switch, and the like constructing the power receiving and transforming equipment and monitoring and measurement of their voltage, current, power, and the like.

In this case, important considerations are how the installation space for the above devices and monitoring and measuring instruments should be reduced for size and weight reduction and suppression of investment in installation.

Further, it is important to give sufficient consideration to safety as well as a wide variety of users' other demands. For example, some of important considerations are to enhance the safety of installed switchgear against earthquakes and the like and to fulfill a failsafe function in a failure in an operating system for a circuit breaker.

SUMMARY OF THE INVENTION

The invention has been made based on the foregoing. An object of the invention is to provide vacuum insulated switchgear that makes it possible to enhance the safety and reliability of the switchgear against earthquakes and the like during transportation and setting and after installation, and to fulfill a failsafe function in a failure, such as breakage in an operating mechanical section of the switchgear.

To attain the above object, the present invention provides a vacuum insulated switchgear comprising an enclosure having a switch block defined by a grounded metal plate, a bus block positioned above the switch block, and a cable block positioned beside the switch block; a switch installed in the switch block; a bus electrically connected with the switch and installed in the bus block; and a cable electrically connected with the switch and installed in the cable block.

The present invention further provides a vacuum insulated switchgear comprising an enclosure having a switch block defined by a grounded metal plate, a bus block positioned above the switch block, and a cable block positioned beside the switch block; a switch and an operating device therefor installed in the switch block; a bus electrically connected with the switch and installed in the bus block; and a cable electrically connected with the switch and installed in the cable block. In this switchgear, the switch block is positioned at a lower level than the intermediate portion of the enclosure in the direction of height; and the switch and the operating device are disposed in the switch block. The switch can be provided with a movable contact positioned below its fixed contact.

In a vacuum insulated switchgear according to the invention, a switch and an operating mechanical section interlocking therewith are disposed in a switch block positioned at a lower level than the intermediate portion of an enclosure in the direction of height. The switch is the heaviest one among the devices housed in the enclosure. Therefore, the center of gravity of the entire switchgear can be set to a low position. As a result, the stability of the switchgear during transportation and setting is enhanced, and thus workability can be enhanced. Further, the installed switchgear is excellent in stability against earthquakes and the like, and its safety and reliability can be enhanced.

Further, in the vacuum insulated switchgear according to the invention, the switch is disposed in the enclosure so that its movable contact is positioned below its fixed contact. If the operating mechanical section is broken, therefore, the movable contact is moved away from the fixed contact by its own weight. Therefore, a failsafe function is fulfilled, and the safety can be enhanced.

Figure 1:
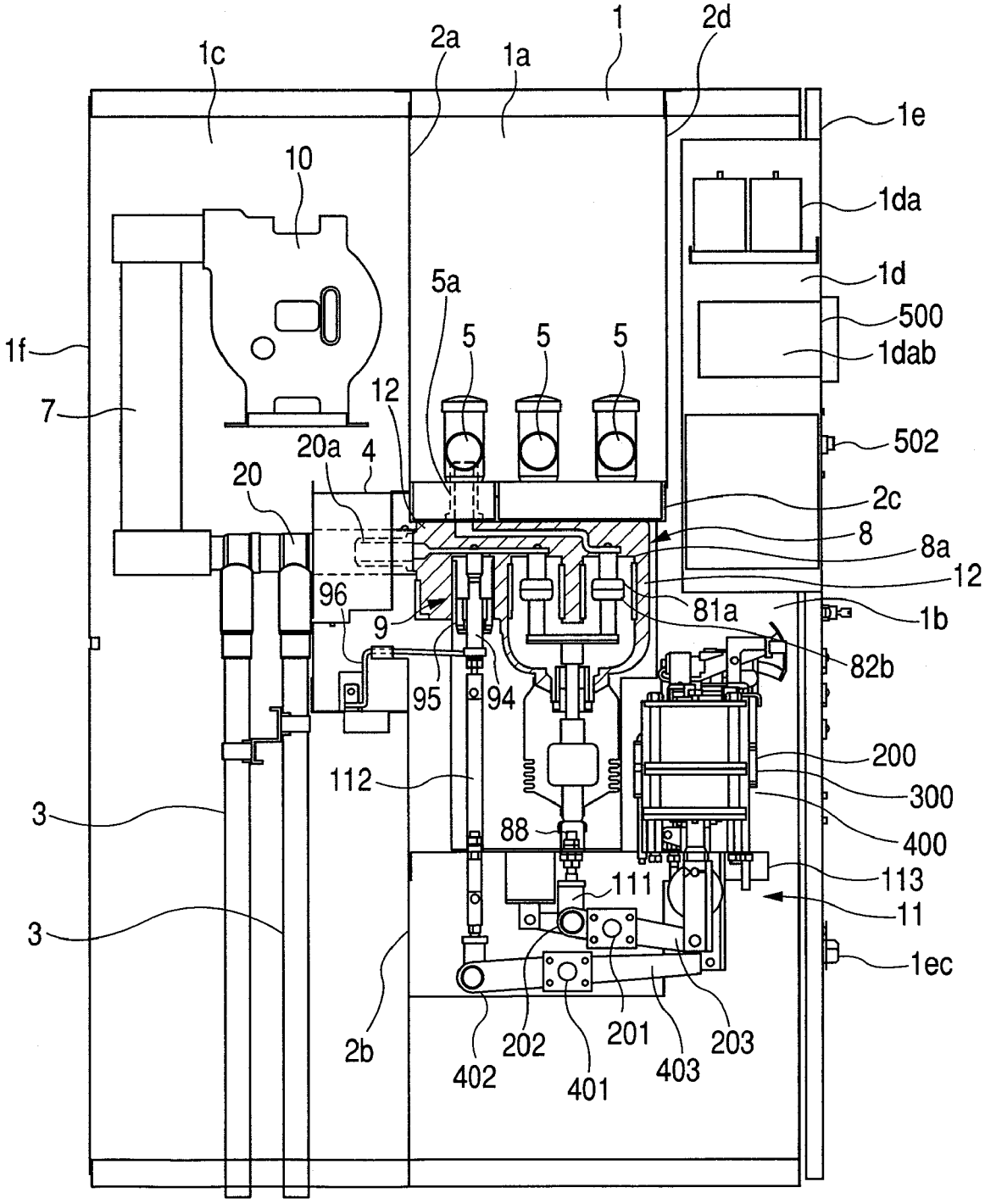
FIG. 1 is a partly cross sectional side view illustrating an embodiment in which vacuum insulated switchgear of the invention is applied to a feeder panel.
Figure 2:
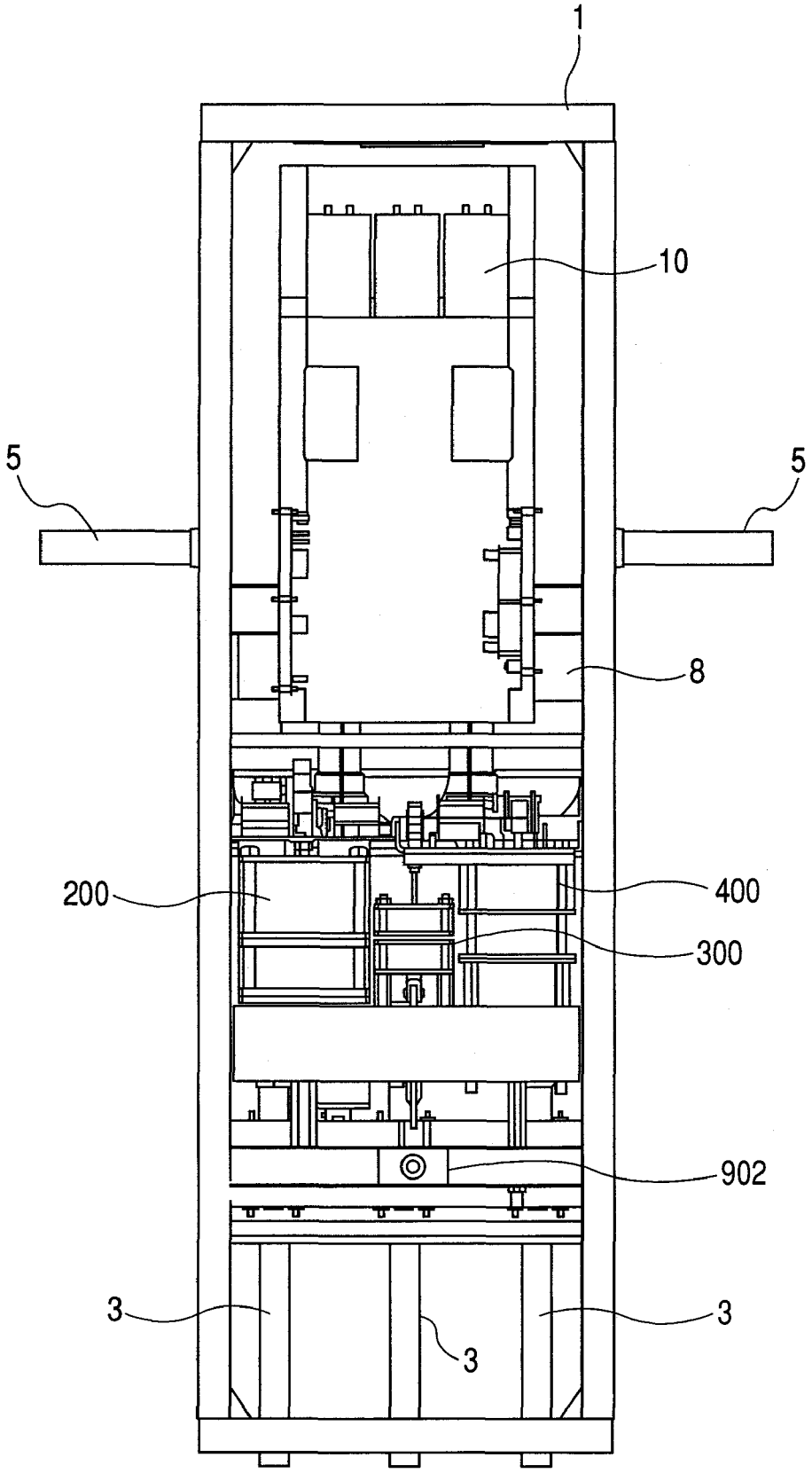
FIG. 2 is a partly cross sectional front view of the embodiment illustrated in FIG. 1.
Figure 3:
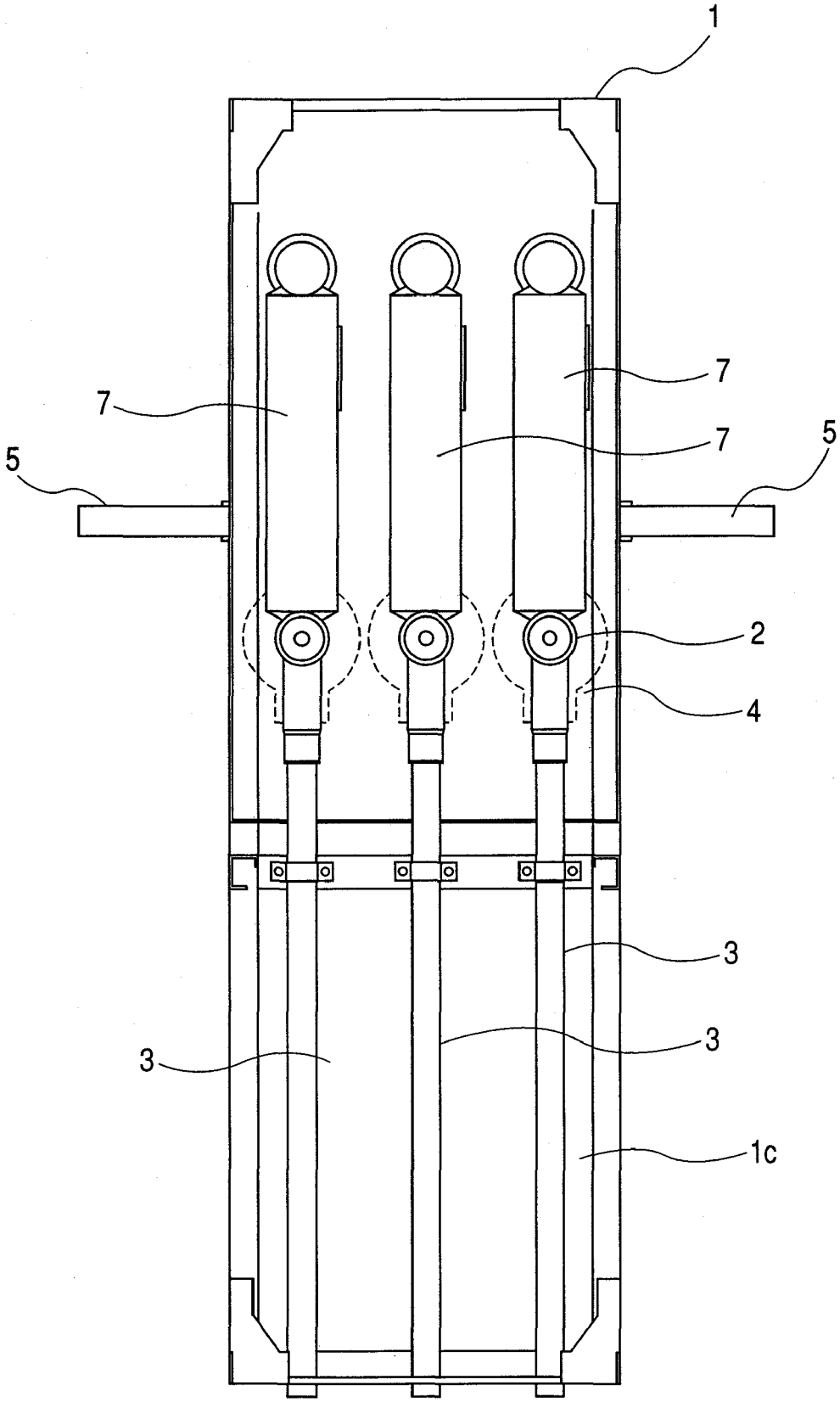
FIG. 3 is a partly cross sectional back view of the embodiment illustrated in FIG. 1.

Reference numerals used in the drawings are:

1 denotes an enclosure, 1*a* a bus block, 1*b* a switch block, 1*c* a cable block, 1*d* a low voltage control block, 1*e* a front door at the front side, if a rear door at the rear side, 2*a*-2*d* a grounded metal plate, 3*a* cable, 4 a current transformer, 5 a bus, 5*a* a connecting bushing, 7 a fuse, 8 a vacuum double-break three-position switch, 9 a vacuum earthing switch, 10 a single-phase wound voltage transformer, 11 an operating device, 12 epoxy resin, 20 a T shaped cable head, 20*a* a cable connecting terminal, 80, 91 a vacuum case, 80*a*, 91*a* an insulating cylinder, 81*a*, 81*b*, 92, a fixed contact, 82*a*, 82*b*, 93 a movable contact, 83, 84 a feeder, 85 a movable conductor, 86, 94 a vacuum insulated operating rod, 87, 95 a metal bellows, 88 an air insulated insulating operating rod, 113 a supporting plate, 200 a first operating mechanism, 300 a second operating mechanism, and 400 a third operating mechanism.

DETAILED DESCRIPTION OF THE PREFERRED EMBODIMENTS

As mentioned before, The vacuum insulated switchgear of the invention that achieves the above mentioned objects is realized by a low-cost and simple construction.

First Embodiment

Hereafter, description will be given to an embodiment of a vacuum insulated switchgear of the invention with reference to drawings.

FIG. 1 to FIG. 5 illustrate an embodiment in which vacuum insulated switchgear of the invention is applied to a feeder panel.

In the vacuum insulated switchgear in these drawings, its enclosure 1 is partitioned into the following by grounded metal plates 2*a*, 2*b*, 2*c*, 2*d* disposed therein: a bus block 1*a*, a switch block 1*b*, a cable block 1*c*, and a low-voltage control block 1*d*. The enclosure 1 is provided on its front side (right side of FIG. 1) with a font door 1*e* and on its rear side (left side of FIG. 1) with a rear door 1*f*.

The bus block 1*a* is disposed in proximity to the center of the direction of the depth of the enclosure 1 (horizontal direction in FIG. 1) on the upper side. The switch block 1*b* is disposed below the bus block 1*a*, and the cable block 1*c* is disposed on the rear side of the enclosure 1 (left side of FIG. 1). The low-voltage control block 1*d* is disposed on the upper side of the back face of the front door 1*e*, and is positioned opposite to the bus block 1*a*.

In the bus block 1*a*, three-phase solid insulated buses (BS) 5 are disposed in parallel with the front face of the enclosure 1 through connecting bushings 5*a* (in the direction orthogonal to the plane of FIG. 1). The buses 5 are insulated by a solid insulator and are made free from gas. Avoidance of use of gas makes gas management unnecessary and the switchgear easier to handle. In addition, even when dust or foreign mater enters the room of installation, insulation is maintained and the safety remains ensured because of solid insulation.

In the switch block 1*b*, the following, described in detail later, are disposed: a vacuum double-break three-position switch (vacuum double-break three-position circuit breaker-disconnector CBDS) 8; a vacuum earthing switch (ES) 9; and an operating device 11.

In the cable block 1*c*, the following are provided: a cable connecting terminal 20*a* connected to the fixed contact 81*a* of the vacuum double-break three-position switch 8 and the fixed contact of the vacuum earthing switch 9 and led into the cable block 1*c*; a T-shaped cable head 20 rotatably provided on the cable connecting terminal 20*a*; two pairs of cables 3 (6 cables for three phases) disposed at the upper part or the lower part by rotating the T-shaped cable head 20 and connected to the terminal 20*a*; and a system protecting current transformer (CT) 4 provided on the circumferential surface of the cable connecting terminal 20*a*. In this example, the cables 3 are led into the cable block 1*c* from the lower part of the enclosure 1. The cable connecting terminal 20*a* is connected by means of a member with a fuse 7 and a single-phase wound voltage transformer (VT) 10. The fuse 7 and the single-phase wound voltage transformer 10 are disposed on the upper side in the cable block 1*c*.

Figure 4:
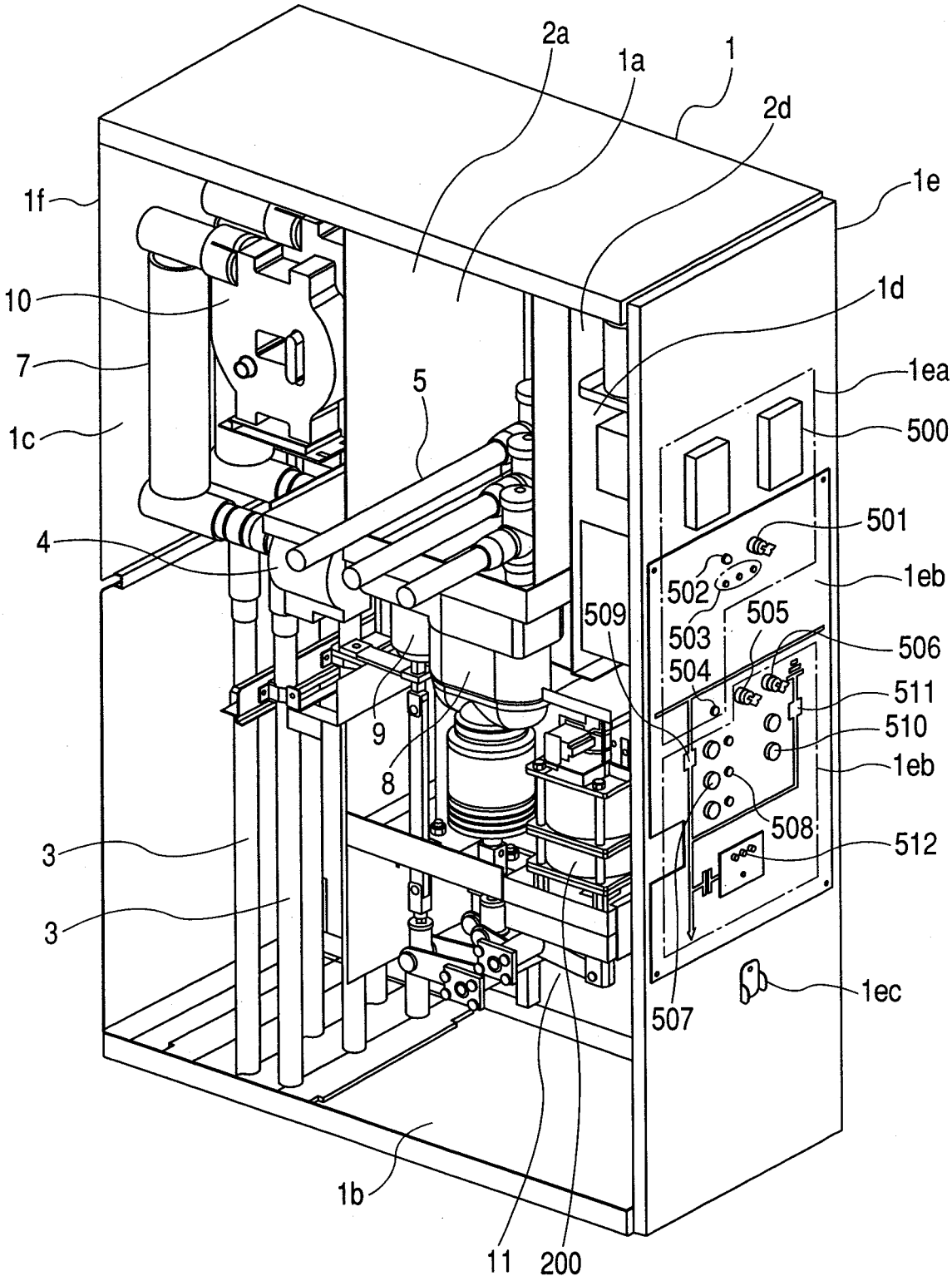
FIG. 4 is a partly cross sectional perspective view of the embodiment illustrated in FIG. 1.
Figure 5:
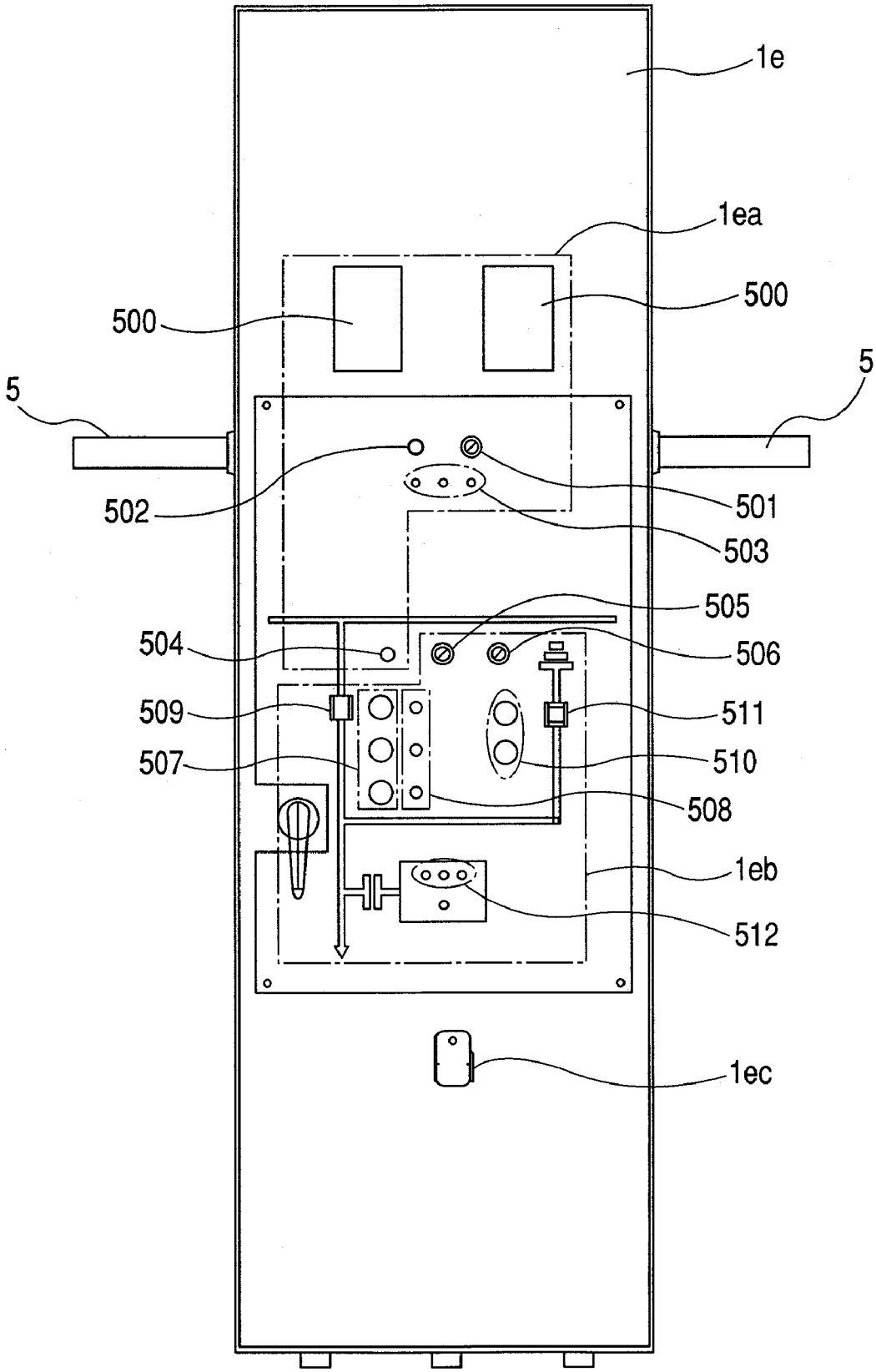
FIG. 5 is a drawing illustrating a front door illustrated in FIG. 1.

In the low-voltage control block 1*d*, the following is disposed on the back face of the front door 1*e*: a low-voltage control section composed of capacitors 1*da* and a protective relay 1*dab*. On the front face of the front door 1*e*, as illustrated in FIG. 4 and FIG. 5, the following are disposed from top down: an alarm display section lea for displaying alarms about grounding and short-circuiting faults, capacitor anomaly, vacuum pressure anomaly, and the like; an operating switch section 1*eb* including various operating switches; and the emergency manual handle operating section 1*ec*.

In the alarm display section 1*ea*, for example, the following are disposed: two display sections 500 for displaying grounding and short-circuiting faults; a display section 501 for enable or disable of interlock; an anomaly display section 502 for capacitor; an anomaly display section 503 for vacuum pressure; and a display section 504 for displaying the completion of capacitor charge.

In the operating switch section 1*eb*, for example, the following are installed: an operation selector switch 505 for the vacuum double-break three-position switch 8 and the vacuum earthing switch 9; a remote-local selector switch 506; an operating switch 507 for turning on/off or disconnecting the vacuum double-break three-position switch 8; position indicator lamps 508 for the vacuum double-break three-position switch 8; a mechanical position display section 509 for the vacuum double-break three-position switch 8; an operating switch 510 for grounding or turning off the vacuum earthing switch 9; a mechanical position display section 511 for the vacuum earthing switch 9; voltage detecting and phase indicating terminals 512; and the like.

Further, the emergency manual handle operating section 1*ec* is installed below them. The configuration of the emergency manual handle operating section 1*ec* will be described later.

Figure 6:
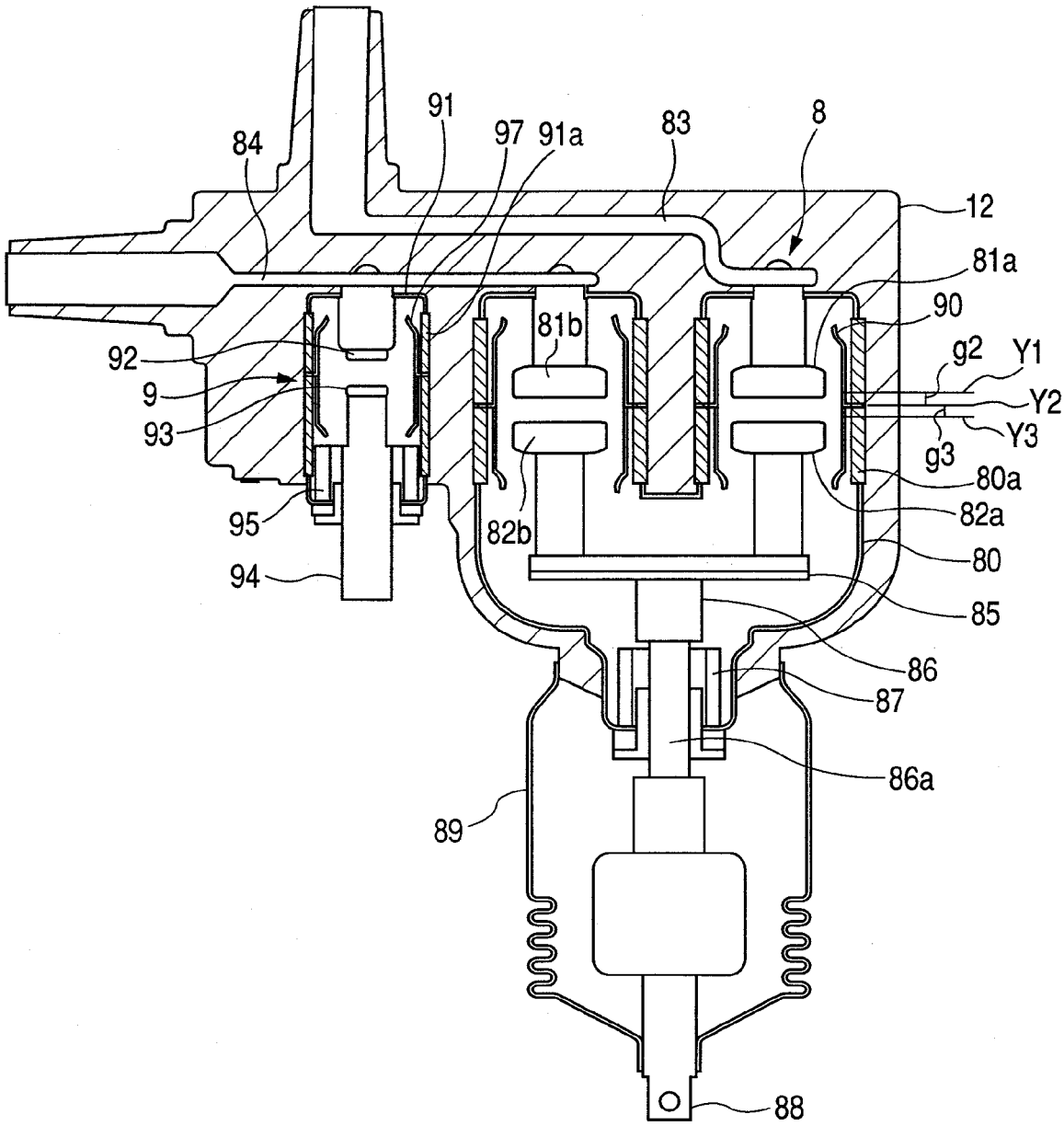
FIG. 6 is a longitudinal cross sectional view of the vacuum insulated switchgear illustrated in FIG. 1.

The vacuum double-break three-position switch 8 and the vacuum earthing switch 9 disposed in the above-mentioned switch block 1*b* are integrally molded with epoxy resin 12 as illustrated in FIG. 1 and FIG. 6. This unitizes the switch portion for size and weight reduction. The unitized switch portion is of phase separation structure, and is installed orthogonal to the front face of the enclosure 1. Further, a shielding panel is disposed between united switch portions to suppress the occurrence of a short-circuiting fault between phases. The outer surface of the above-mentioned molded epoxy resin 12 is grounded by conductive coating material applied thereto to ensure the safety in case of contact.

Detailed description will be given to the configuration of the above-mentioned unitized switch portion with reference to FIG. 1 and FIG. 6.

As illustrated in these drawings, the vacuum double-break three-position switch 8 includes: a vacuum case 80 having insulating cylinders 80*a*; two fixed contacts 81*a* and 81*b* housed in the vacuum case 80; two movable contacts 82*a* and 82*b* that can be respectively brought into and out of contact with the fixed contacts 81*a* and 81*b*; and arc shields 90 that are supported in the respective insulating cylinders 80*a* and cover the areas surrounding the left and right fixed contact 81*b*, 81*b* and movable contacts 82*a*, 82*b* including these contacts. Double break is achieved by the two fixed contacts 81*a* and 81*b* and two movable contacts 82*a* and 82*b*.

The right fixed contact 81*a* in FIG. 6 is connected to a bus 5 through a feeder 83, and the left fixed contact 81*b* is connected to a terminal 2*a* through a feeder 84. The movable contact 82*a* and the movable contact 82*b* are coupled with each other through a movable conductor 85 reinforced by metal, such as stainless steel, that is not annealed at high temperature. The movable conductor 85 is coupled with a vacuum insulated operating rod 86, and the vacuum insulated operating rod 86 is coupled with a coupling rod 86*a*. The coupling rod 86*a* is vacuum sealed with a metal bellows 87, and is led out to the exterior of the vacuum case 80 and coupled with an air insulated operating rod 88. The area around the joint between the air insulated operating rod 88 and the coupling rod is enveloped with a rubber or metal bellows 89. As illustrated in FIG. 1, the air insulated operating rod 88 is coupled with an operating rod 111 operated through the operating device 11.

The two movable contacts 82*a* and 82*b* are operated through the operating device 11 coupled with the operating rod 111 so that they are stopped in the three positions illustrated in FIG. 6: closed position Y1 for energization; open position Y2 for interrupting a load current or a fault current; and disconnected position Y3 for ensuring the safety of inspecting personnel against surge voltage of lightening and the like.

As illustrated in FIG. 6, the above-mentioned two movable contacts 82*a* and 82*b* respectively ensure an interrupting gap g2 in the open position Y2. This gap is equivalent to the distance between the closed position Y1 and the open position Y2. The two movable contacts 82*a* and 82*b* respectively ensure an isolating gap g2+g3 in the disconnected position Y3. The isolating gap g2+g3 is so set that a pole-to-pole distance equivalent to substantially twice the interrupting gap g2 is ensured. As mentioned above, the isolating gap g2+g3 in isolation is set to substantially twice the interrupting gap g2. These multiplied-long gaps contribute to improvement of the insulation performance.

The following relation can be established by providing mold insulation between phases and vacuum insulation between the poles of contacts and varying the above-mentioned pole-to-pole distance and a number of poles: relation expressed as "phase-to-phase insulation>pole-to-pole insulation in isolation>pole-to-pole insulation in interruption> the pole-to-pole insulation of earthing switch." This facilitates insulation coordination between phases. As a result, the severity of grounding faults is lightened to one-line ground at the worst, and it is possible to suppress spreading of faults as much as possible. Since the above-mentioned air insulated operating rod 88 is enveloped with the rubber or metal bellows 89 and is shielded from the outside air, the reliability of insulation is ensured for long-term use.

Detailed description will be given to the configuration of the above-mentioned vacuum earthing switch 9 with reference to FIG. 1 and FIG. 6.

As illustrated in these drawings, the vacuum earthing switch 9 includes: a vacuum case 91 having an insulating cylinder 91*a*; a fixed contact 92 housed in the vacuum case 91 and connected to the feeder 84; a movable contact 93 that can be brought into and out of contact with the fixed contact 92; and an arc shield 97 that is supported in the insulating cylinder 91*a* and covers the area around the fixed contact 92 and the movable contact 93. The movable contact 93 is coupled with a movable conductor 94. The movable conductor 94 is led out of the vacuum case 91 through a metal bellows 95, and is coupled with an insulated operating rod 112 for the vacuum earthing switch 9. Stainless steel is used for the material of the vacuum case 80 and this enhances their environment resistance. As illustrated in FIG. 1, the movable contact 93 is connected to ground by a conductor 96 through the movable conductor 94.

Detailed description will be given to the configuration of the operating device 11 with reference to FIG. 1 and FIG. 7. The operating device 11 is for changing the position of the vacuum double-break three-position switch 8 among the three positions: the closed position Y1 for energization; the open position Y2 for interrupting a load current or a fault current; and the disconnected position Y3 for ensuring the safety of inspecting personnel against surge voltage of lightening and the like. The operating device 11 is also for turning on and off the vacuum earthing switch 9.

As illustrated in these drawings, the components of the operating device 11 are fixed on a supporting plate 113 provided in the switch block 1*b*. The operating device 11 is substantially constructed of: a first operating mechanism 200 for shifting the movable contacts 82*a*, 82*b* of the vacuum double-break three-position switch 8 between the closed position Y1 and the open position Y2; a second operating mechanism 300 for shifting the movable contacts 82*a*, 82*b* of the vacuum double-break three-position switch 8 between the open position Y2 and the disconnected position Y3; and a third operating mechanism 400 for operating the movable contact 93 of the vacuum earthing switch 9.

Description will be given to the configuration of the first operating mechanism 200 with reference to FIG. 7 and FIG. 1. As illustrated in these drawings, a first shaft 201 is rotatably supported by the supporting plate 113, and three levers 202 are fixed on the first shaft 201 on one side in the direction of the axis of the first shaft 201. The tips of the levers 202 are respectively coupled with the operating rods 111. On the opposite side of the first shaft 201, a lever 203 is fixed in the opposite side to the direction of the levers 202.

Figure 7:
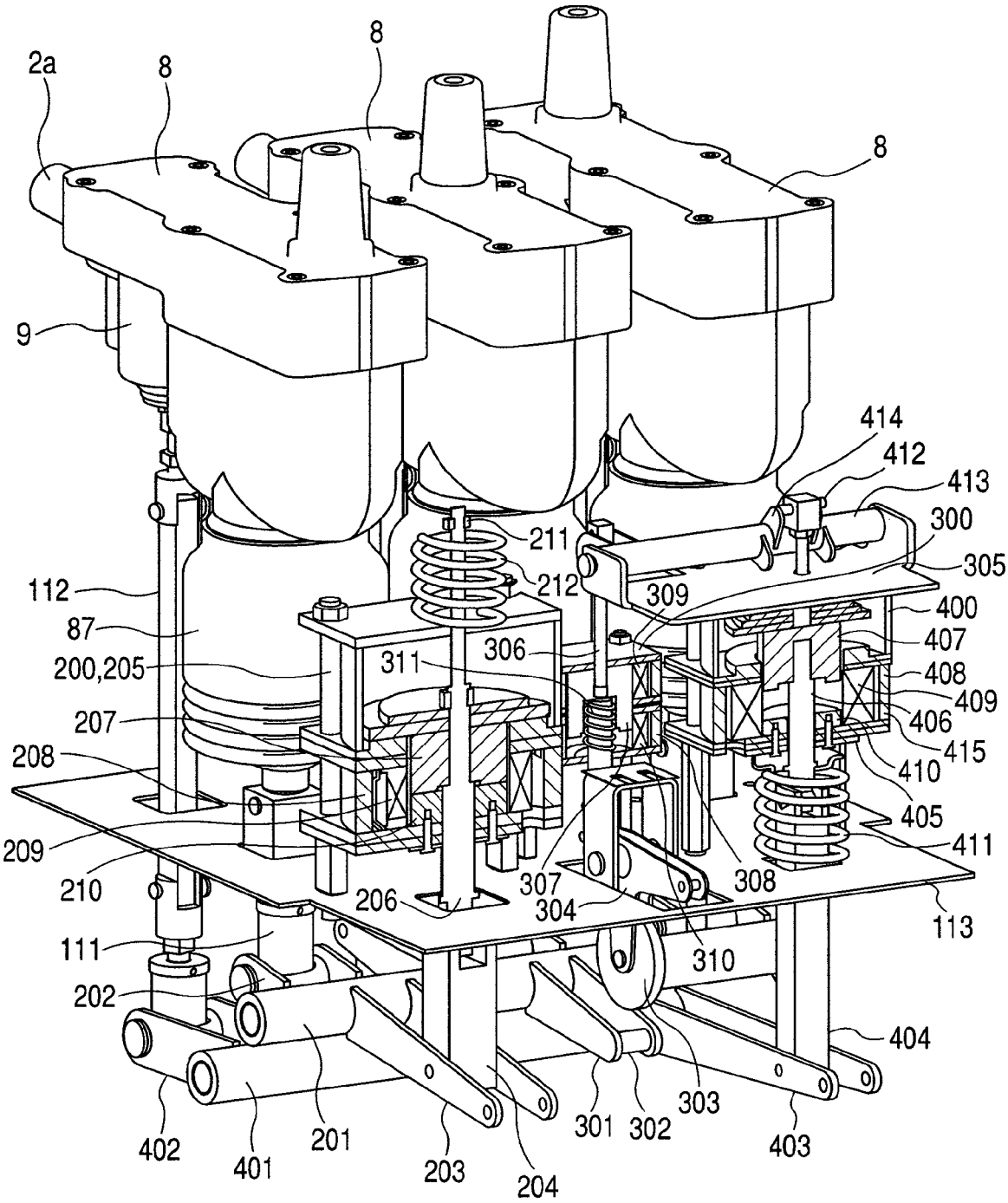
FIG. 7 is a partly cross sectional enlarged perspective view of an embodiment of an operating mechanism for the vacuum insulated switchgear illustrated in FIG. 1.

As illustrated in FIG. 7, the lever 203 is coupled with the driving shaft 206 of an electromagnet 205 through a coupling member 204. On the driving shaft 206, there is fixed a moving core 207 having T-shaped sections. Around the moving core 207, there is provided a fixed core 208 fixed on the supporting plate 113, and in the fixed core 208, there are disposed a coil 209 and an annular permanent magnet 210. On the opposite side to the lever 203 with respect to the driving shaft 206, there is provided a trip spring bearing 211, and a trip spring 212 is provided between the trip spring bearing 211 and the fixed core 208.

The electromagnet 205 is so constructed that the following is implemented when the movable contacts 82*a*, 82*b* are held in the closed position Y1: holding force countervailing the accumulate energy of the trip spring 212 and a pressure contact spring (not shown) provided on the air insulated operating rod 88 can be obtained by the attractive force of the coil 209 and the permanent magnet 210.

Description will be given to the configuration of the second operating mechanism 300 with reference to FIG. 7. The second operating mechanism 300 is for shifting the movable contacts 82*a*, 82*b* of the vacuum double-break three-position switch 8 between the open position Y2 and the disconnected position Y3. As illustrated in the drawing, a lever 301 is fixed on the intermediate portion of the first shaft 201 in the direction of length on the supporting plate 113. The lever 301 is provided at its tip with an interlock pin 302. The pin 302 has a roller 303 abutted against it, and the roller 303 is rotatably provided at the end of a crank lever 304 on one side. The crank lever 304 is supported so that it can be rotated to the underside of the supporting plate 113.

The end of the crank lever 304 on the other side is coupled with the driving shaft 306 of an electromagnet 305, and on the driving shaft 306, there is fixed a moving core 307. Around the moving core 307, there is provided a fixed core 308 fixed on the supporting plate 113, and in the fixed core 308, there are disposed two coils 309, 310 in the vertical direction. A return spring 311 is disposed between the moving core 307 and the upper part of the fixed core 308.

The electromagnet 305 excites the individual coils 309, 310 to move the moving core 307 in the vertical direction, and the crank lever 304 is rotated by this operation. The position of abutment between the interlock pin 302 and the roller 303 is changed by this rotation of the crank lever 304. As a result, the lever 203 is prevented from rotating around the first shaft 201 or permitted to rotate.

Thus, the movable contacts 82*a*, 82*b* of the vacuum double-break three-position switch 8 are prevented from moving from the open position Y2 to the disconnected position Y3 illustrated in FIG. 6 and held in the open position Y2. Or, they are permitted to move from the open position Y2 to the disconnected position Y3. That is, this construction makes a first interlock mechanism of the movable contacts 82 of the vacuum double-break three-position switch 8 between the open position Y2 and the disconnected position Y3.

Description will be given to the configuration of the third operating mechanism 400 for operating the movable contact 93 of the vacuum earthing switch 9 with reference to FIG. 7. As illustrated in the drawing, a second shaft 401 is rotatably supported on the supporting plate 113, and on one side of the second shaft 401, there are fixed three levers 402 in the direction of the axis of the second shaft 401. The tips of the levers 402 are respectively coupled with the operating rods 112, and on the other side of the second shaft 401, there is fixed a lever 403 in the opposite direction to the levers 402.

The lever 403 is coupled with the driving shaft 406 of an electromagnet 405 through a coupling member 404. The electromagnet 405 is constructed similarly with the above-mentioned electromagnet 205 of the first operating mechanism 200. On the driving shaft 406, there is fixed a moving core 407 having T-shaped sections. Around the moving core 407, there is provided a fixed core 408 fixed on the supporting plate 113, and in the fixed core 408, there are disposed a coil 409 and an annular permanent magnet 410. Between the fixed core 408 and the lower face of the supporting plate 113, there is provided a trip spring 411.

Between the third operating mechanism 400 of the vacuum earthing switch 9 and the second operating mechanism 300, there is provided a second interlock mechanism. The second operating mechanism 300 is for shifting the movable contacts 82*a*, 82*b* of the vacuum double-break three-position switch 8 between the open position Y2 and the disconnected position Y3. The second interlock mechanism is related to various elements so that the operation described below is carried out. When the movable contacts 82*a*, 82*b* of the vacuum double-break three-position switch 8 are in a third position, or the disconnected position Y3 for ensuring the safety of inspecting personnel against surge voltage of lightening and the like, the second interlock mechanism performs the following operation: it enables the movable contact 93 of the vacuum earthing switch 9 to be brought into contact with the fixed contact by the electromagnet 405. When the movable contacts 82*a*, 82*b* of the vacuum double-break three-position switch 8 are in a second position, or the open position Y2 for interrupting a current, it disables the movable contact 93 of the vacuum earthing switch 9 to be brought into contact with the fixed contact by the electromagnet 405. When the movable contact 93 is in contact with the fixed contact 92 of the vacuum earthing switch 9, it disables the operation of the electromagnet 205 of the second operating mechanism 300.

Specifically, the above-mentioned second interlock mechanism is constructed of: a pin 412 provided at the lower end of the driving shaft 406 of the electromagnet 405 of the third operating mechanism 400; a shaft 413 provided in parallel with the second shaft 401 below the electromagnet 305 of the operating mechanism 300; a lever (not shown) provided on the shaft 413 and coupled with the lower end of the driving shaft 306 of the electromagnet 305 of the second operating mechanism 300; and a lever 414 provided on the shaft 413 and engaged with the pin 412.

Description will be given to the operation of an embodiment in which vacuum insulated switchgear of the invention is applied to a feeder panel with reference to FIG. 1 to FIG. 7.

When the movable contacts 82*a*, 82*b* of the vacuum double-break three-position switch 8 are set in the open position Y2 for interrupting a load current or a fault current, the following takes place: the lever 203 of the first operating mechanism 200 is supplied with counterclockwise torque in FIG. 7 with the first shaft 201 taken as the fulcrum by return force of the trip spring 212 of the first operating mechanism 200.

Thus, the interlock pin 302 provided at the tip of the lever 301 constructing the second operating mechanism 300 is abutted against the outer circumferential surface of the roller 303. Further counterclockwise rotation is prevented by return force of the trip spring 212. That is, transition from the open position Y2 for interrupting a load current or a fault current to the disconnected position Y3 for ensuring the safety of inspecting personnel against surge voltage of lightening and the like is arrested.

Description will be given to the operation for transition from the open position Y2 to the closed position Y1 by the first operating mechanism 200 (making operation).

When the coil 209 of the electromagnet 205 of the first operating mechanism 200, the driving shaft 206 is moved downward in FIG. 7. By this downward movement of the driving shaft 206, the levers 202 are rotated clockwise in FIG.

7 with the first shaft 201 taken as the fulcrum, and the movable contacts 82*a*, 82*b* are moved toward the closed position Y1. In this closed state, energy is accumulated in the trip spring 212 and the pressure contact spring, and these springs are ready for contact parting operation.

As the result of this making operation, the interlock pin 302 is parted from the outer circumferential surface of the roller 303. The roller 303 does not change its position because of the return spring 311 of the second operating mechanism and is held in its initial position.

As mentioned above, the second operating mechanism 300 constructs a mechanical interlock mechanism so that the following is implemented to satisfy needs for enhanced safety: when the vacuum double-break three-position switch 8 is closed, isolating operation by the first operating mechanism 200 is disabled. That is, the following operation as one of mechanical interlocks between interruption and isolation is accomplished: "when a movable contact is in a closed position, isolating operation is disabled."

Description will be given to the operation for transition from the closed position Y1 to the open position Y2 by the first operating mechanism 200 (contact parting operation).

When the coil 209 of the electromagnet 205 of the first operating mechanism 200 is excited in the opposite direction to the direction in making operation to cancel the magnetic flux of the permanent magnet 210, the following takes place: the driving shaft 206 is moved upward in FIG. 7 by the accumulated energy of the trip spring 212 and the pressure contact spring. By this upward movement of the driving shaft 206, the lever 301 is rotated counterclockwise in FIG. 7 through the lever 203 and the first shaft 201. However, the counterclockwise rotation of the lever 301 is suppressed by the abutment between the interlock pin 302 of the second operating mechanism and the outer circumferential surface of the roller 303. As a result, the movable contacts 82*a*, 82*b* of the vacuum double-break three-position switch 8 can be held in the open position Y2.

Description will be given to the operation for transition from the open position Y2 to the disconnected position Y3 by the second operating mechanism 300 (isolating operation).

When the upper coil 309 of the electromagnet 305 of the second operating mechanism 300 is excited with the vacuum double-break three-position switch 8 in the closed state, mentioned above, the driving shaft 306 is moved downward against the return spring 311. The downward movement of the driving shaft 306 rotates the roller 303 clockwise in FIG. 7 through the crank lever 304. By the clockwise rotation of the roller 303, the position of abutment between the roller 303 and the interlock pin 302 is shifted upward by the force of trip spring 212. As a result, the operating rods 111 are moved downward through the lever 301, first shaft 201, and levers 202, and the movable contacts 82*a*, 82*b* of the vacuum double-break three-position switch 8 are moved to the disconnected position Y3.

In this isolated state, the moving core 207 of the electromagnet 205 of the first operating mechanism 200 is positioned outside the coil 209. For this reason, even if the coil 209 of the electromagnet 205 of the first operating mechanism 200 is excited in the isolated state, substantially no magnetic flux passes through the moving core 207 and attractive force is not produced. That is, the following operation as a mechanical interlock between a circuit breaker and a disconnector is accomplished: when a movable contact is in a disconnected position, making operation is disabled."

Description will be given to the operation for transition from the disconnected position Y3 to the open position Y2 by the second operating mechanism 300. When the upper coil 309 of the electromagnet 205 of the second operating mechanism 300 is excited in the isolated state, the following takes place: the roller 303 pushes downward the interlock pin 302 abutted against it by the downward movement of the driving shaft 206 and the counterclockwise rotation of the crank lever 304. As a result, the movable contacts 82*a*, 82*b* of the vacuum double-break three-position switch 8 are moved to the open position Y2.

When the movable contacts 82*a*, 82*b* of the vacuum double-break three-position switch 8 are in the open position Y2 for interrupting a current, the following takes place: the lever 414 of the second interlock mechanism is engaged with the pin 412 provided at the lower end of the driving shaft 406 of the electromagnet 405 of the third operating mechanism 400. Therefore, it is disabled by the electromagnet 405 to close the movable contact 93 of the vacuum earthing switch 9.

When the movable contact 93 is in contact with the fixed contact 92 of the vacuum earthing switch 9, the lever 414 of the second interlock mechanism is engaged with the pin 412 provided at the upper end of the driving shaft 406 of the electromagnet 405. Therefore, operation by the second operating mechanism 300 is disabled. Further, when the movable contacts 82*a*, 82*b* of the vacuum double-break three-position switch 8 are in the disconnected position Y3 for ensuring the safety of inspecting personnel against surge voltage of lightening and the like, the following takes place: the lever 414 of the second interlock mechanism enables the movement of the pin 412 provided at the upper end of the driving shaft 406 of the electromagnet 405. Therefore, the vacuum earthing switch 9 can be turned on by the third operating mechanism 400.

In the above-mentioned embodiment, the rotatable roller 303 is used for the second operating mechanism 300. A partly arc-shaped cam may be substituted for the roller 303. The disposition of the first operating mechanism 200 and the third operating mechanism 400 may be changed as appropriate. In the above-mentioned embodiment, an electromagnetic operating system is applied to the first operating mechanism 200. Instead, any other operating system, such as electric spring system, may be adopted.

In the above-mentioned embodiment of the invention, the vacuum double-break three-position switch 8, which is the heaviest one of the devices housed in the enclosure 1, and the operating device 11 are disposed as illustrated in FIG. 1. That is, they are disposed in the space lower than the intermediate portion of the enclosure 1 in the direction of height. Therefore, the center of gravity of the entire switchgear can be set low. As a result, the safety of transportation and installation work for the switchgear is enhanced, and if an earthquake happens, the installed switchgear is prevented from being toppled and the safety can be ensured.

In the above-mentioned embodiment of the invention, the vacuum double-break three-position switch 8 is disposed in the enclosure 1 so that its movable contacts 82*a*, 82*b* are positioned below its fixed contacts 81*a*, 81*b*. In addition, the operating device 11 for operating the movable contacts 82*a*, 82*b* is also disposed at a lower level in the enclosure 1 in the direction of height in a lump. If the operating device 11 becomes faulty for some reason, therefore, the movable contacts 82*a*, 82*b* of the vacuum double-break three-position switch 8 are moved downward by their own weight and parted from the fixed contacts 81*a*, 81*b*. Thus, a fail safe function is fulfilled, and the safety can be enhanced.

In the above-mentioned embodiment of the invention, the following measures are taken in addition to the above construction: the buses 5 are disposed above the vacuum double-break three-position switch 8, and the vacuum double-break three-position switch 8 and the operating device 11 are disposed at a lower level. Therefore, no operating device is positioned near the joints of the buses 5. This makes it possible to enhance the safety of work of connecting the buses 5.

In the above-mentioned embodiment of the invention, the work of connecting a bus 5 to a bus joint is conducted as follows: the bus 5 is guided from a side of the enclosure 1 into the enclosure 1 and this bus 5 is pulled down from above the bus joint toward the bus joint. As illustrated in FIG. 1, the buses 5 and the bus joints are disposed above the vacuum double-break three-position switch 8. Therefore, the buses 5 and the bus joints are positioned at the level of the worker's breast, and the worker can stably conduct bus connecting work without being required to be in stressful posture. When the front door 1*e* is opened, the low-voltage control section positioned on the back face of the front door 1*e* is moved together out of the enclosure 1. Therefore, the working space for the above-mentioned bus connecting work can be ensured by an amount equivalent to the movement of the low-voltage control section.

A required number of pieces of switchgear are disposed in line before the above-mentioned bus connecting work is conducted. In the above-mentioned embodiment, since a bus connecting work can be conducted after the required switchgears being arranged in a state that each of the switchgears is provided with necessary components that have been subjected to routine tests, the reliability can be enhanced.

As mentioned above, the low-voltage control section positioned on the back face side of the front door 1*e* is unitized, and the low-voltage control section detachably attached to the back face of the front door 1*e*. This makes it possible to easily check the low-voltage control section with ease during maintenance inspection. In addition, a protective relay and the like housed in the low-voltage control section can be easily replaced.

On the front face of the above-mentioned front door 1*e*, as illustrated in FIG. 4 and FIG. 5, the alarm display section lea is disposed at the level of workers' eyes and the operating switch section 1*eb* including various operating switches is disposed at the level of workers' hands. Therefore, workers can easily and efficiently conduct inspecting work. Further, the emergency manual handle operating section 1*ec* is disposed in a lower stage different from the stage of the operating switch section 1*eb* for normal operation. Therefore, the possibility that a worker manually operates it without careful consideration is minimized.

Figure 8:
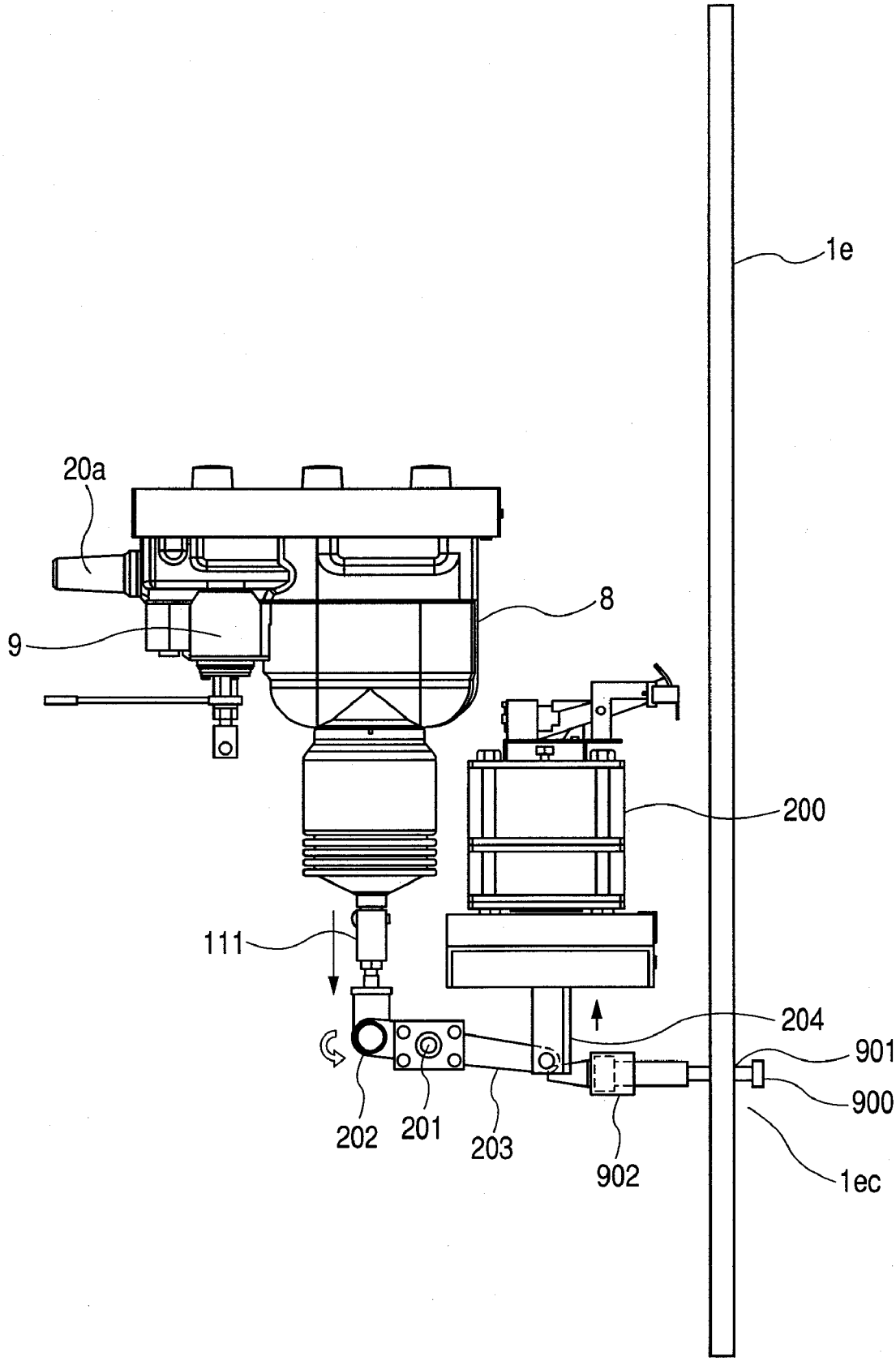
FIG. 8 is a side view explaining the operation of an emergency manual handle operating section of the vacuum insulated switchgear of the invention, which is applied as a feeder panel.

The above-mentioned emergency manual handle operating section 1*ec* is operated as illustrated in FIG. 8, for example. That is, the tip of a manual handle 900 is inserted into a hole 901 in the front door 1*e*, and is screwed into a threaded portion 902 fixed on a side panel of the enclosure 1. Thus, the conical tip of the manual handle 900 is abutted against the lower end of the coupling member 204 of the first operating mechanism 200 in the operating device 11, and pushes the coupling member 204 upward. This makes the accumulated energy of the trip spring 212 and the pressure contact spring larger than the magnetic force of the permanent magnet 207 of the first operating mechanism 200. As a result, the movable contacts 82*a*, 82*b* of the vacuum double-break three-position switch 8 are moved downward, and an open-circuit condition can be established. When the manual handle 900 is thereafter pulled out of the hole 901 in the front door 1*e*, the operation can be completed.

In addition, as illustrated in FIG. 1, the voltage transformer 10 and the protection fuse 7 are disposed in the cable block 1*c* on the rear face side of the enclosure 1. When the rear door if of the enclosure 1 is opened, therefore, the voltage transformer 10 and the protection fuse 7 can be easily inspected, and this enhances the working efficiency.

Figure 9:
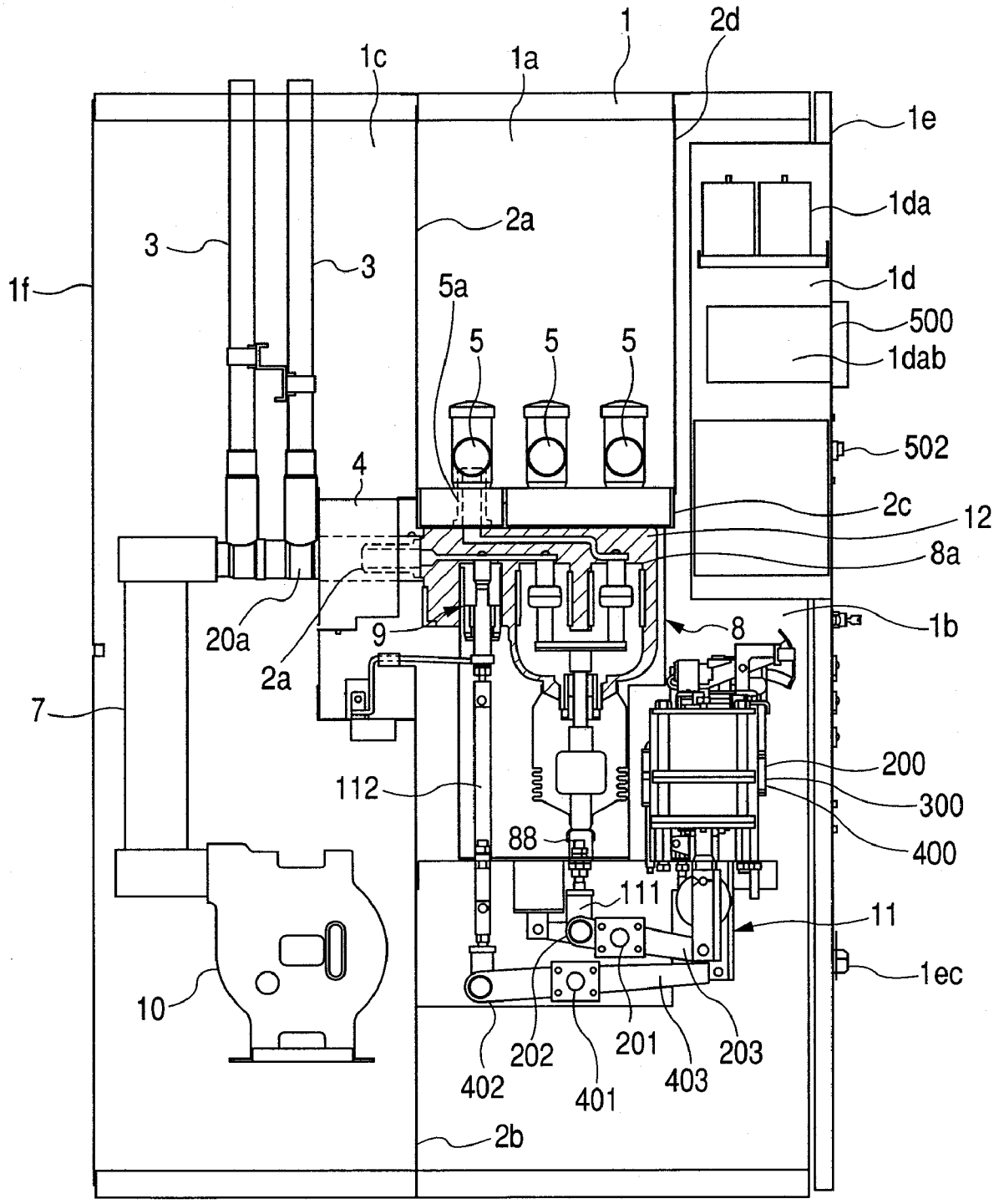
FIG. 9 is a partly cross sectional side view of another embodiment of a vacuum insulated switchgear of the invention, which is applied as a feeder panel.

FIG. 9 illustrates another embodiment in which vacuum insulated switchgear of the invention is applied to a feeder panel. In FIG. 9, the members marked with the same reference numerals as in FIG. 1 are those identical with or equivalent to those in FIG. 1, and the detailed description of them will be omitted.

This embodiment is so constructed that two cables 3 in the cable block 1*c* are pulled out to above the enclosure 1 and the voltage transformer 10 and the protection fuse 7 are disposed at the lower part in the cable block 1*c*. The other constructions are the same as illustrated in FIG. 1.

According to this embodiment, the same effect as the above-mentioned embodiment can be obtained, and further the switchgear can be flexibly connected and installed in correspondence with a wiring pattern of a power cable on the installation site.

Figure 10:
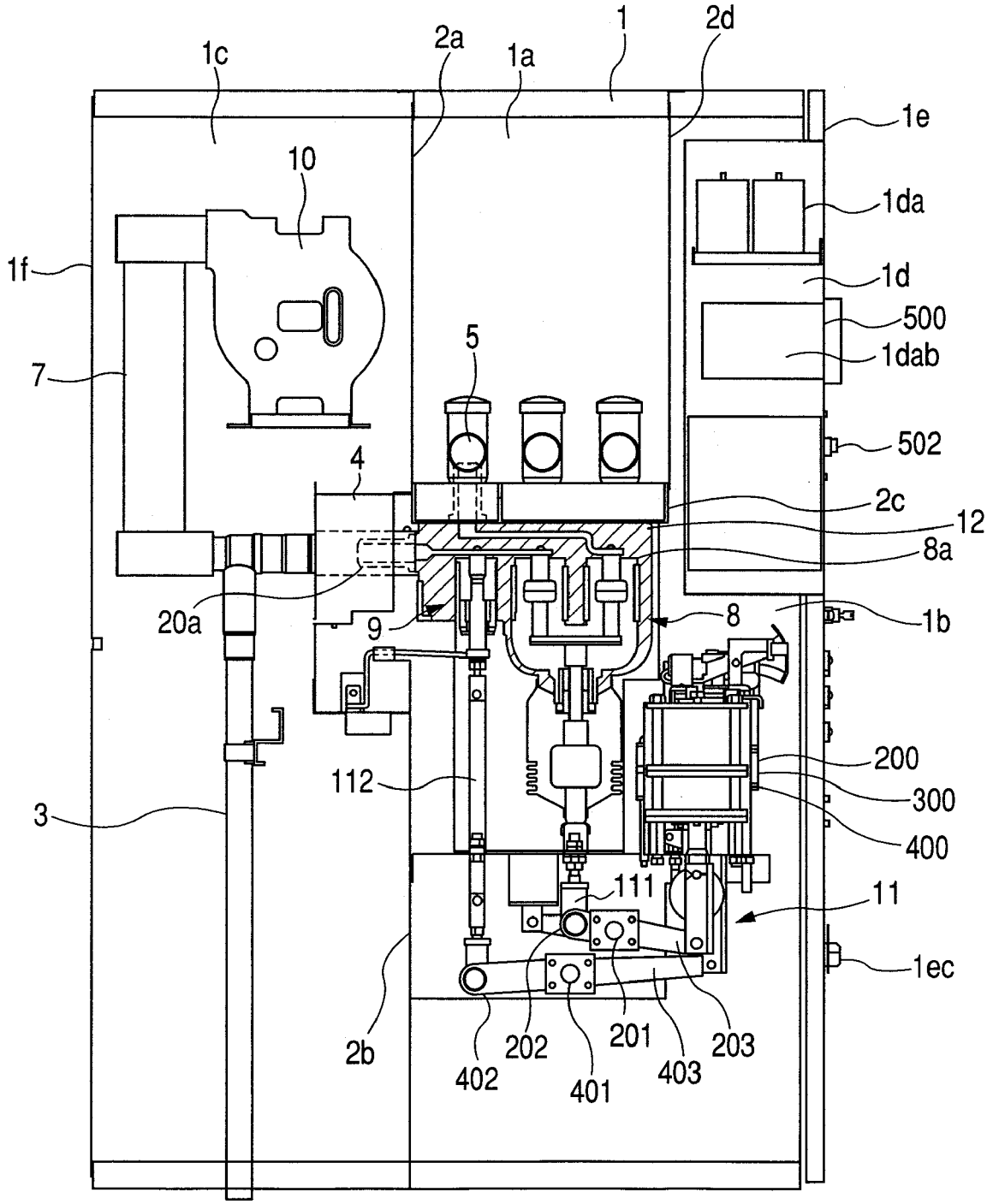
FIG. 10 is a partly cross sectional side view of still another embodiment of a vacuum insulated switchgear of the invention.

FIG. 10 illustrates a further embodiment in which vacuum insulated switchgear of the invention is applied to a feeder panel. In FIG. 10, the members marked with the same reference numerals as in FIG. 1 are those identical with or equivalent to those in FIG. 1, and the detailed description of them will be omitted.

In this embodiment, one cable 3 is provided in the cable block 1*c* to cope with cases where an amount of power supply can be reduced. This cable 3 is pulled out to below the enclosure 1, and the voltage transformer 10 and the protection fuse 7 are disposed at the lower part in the cable block 1*c*. The other constructions are the same as illustrated in FIG. 1.

According to this embodiment, the same effect as the above-mentioned embodiments can be obtained, and further the switchgear can be flexibly connected and installed in correspondence with a wiring pattern of a power cable on the installation site, needless to add. Various amounts of power supply can be flexibly coped with.

Figure 11:
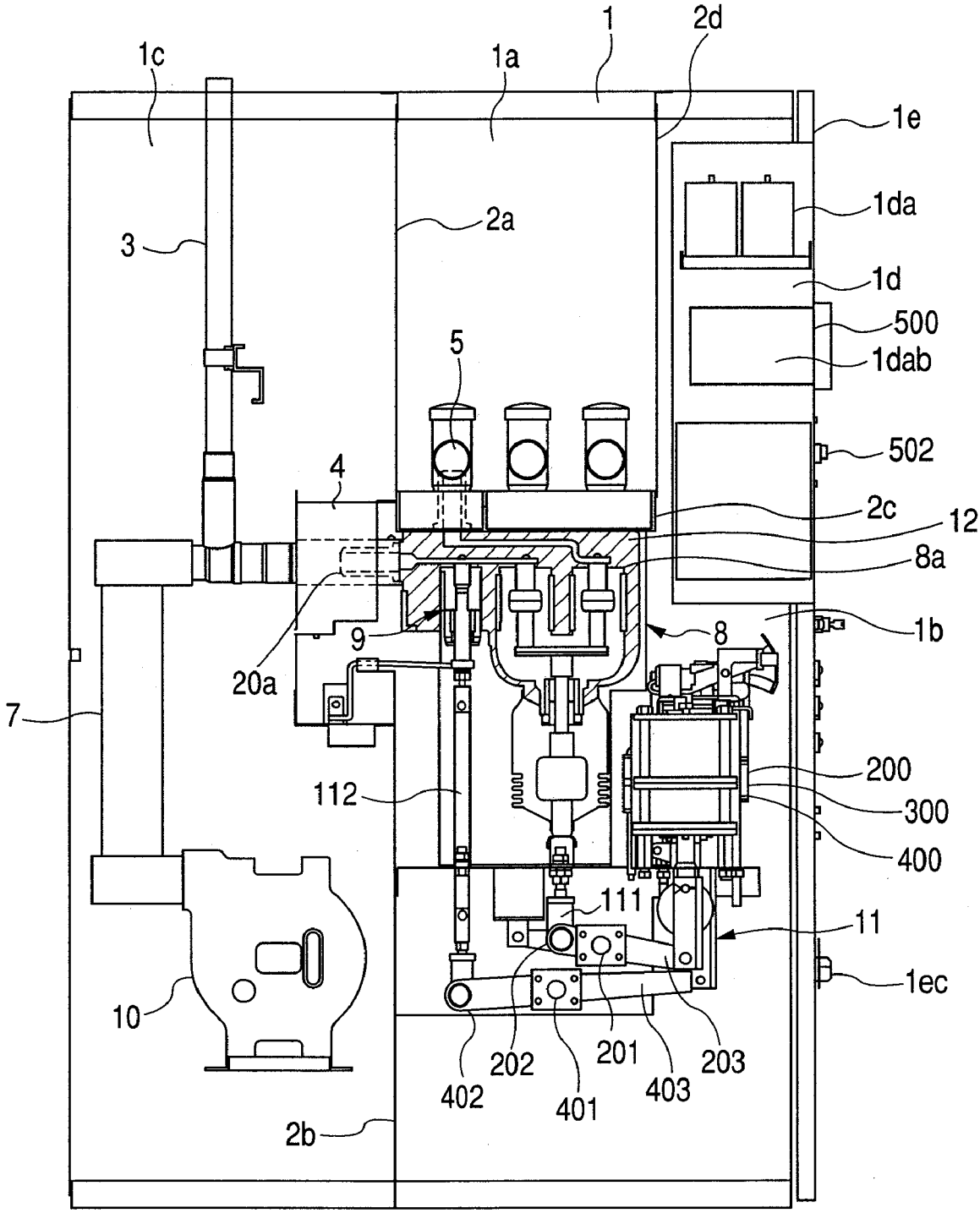
FIG. 11 is a partly cross sectional side view of a still further embodiment of a vacuum insulated switchgear of the invention, which is applied as a feeder measuring board.

FIG. 11 illustrates a further embodiment in which vacuum insulated switchgear of the invention is applied to a feeder panel. In FIG. 11, the members marked with the same reference numerals as in FIG. 1 are those identical with or equivalent to those in FIG. 1, and the detailed description of them will be omitted.

In this embodiment, one cable 3 is provided in the cable block 1*c* to cope with cases where an amount of power supply can be reduced as in the embodiment illustrated in FIG. 10. This cables 3 is pulled out to above the enclosure 1, and the voltage transformer 10 and the protection fuse 7 are disposed at the lower part in the cable block 1*c*. The other constructions are the same as illustrated in FIG. 1.

According to this embodiment, the same effect as the embodiment illustrated in FIG. 10 can be obtained.

In the above-mentioned embodiments, the voltage transformer 10 and the protection fuse 7 are provided in the cable block 1*c*. However, they may be omitted as required.

What is claimed is:

1. A vacuum insulated switchgear comprising:

an enclosure comprising a switch block, a bus block positioned above the switch block, a cable block positioned beside the switch block, and a low voltage control block positioned above the switch block, the blocks being partitioned from each other with grounded metal plates;

a vacuum main switch installed in a vacuum vessel in the switch block;

an earthing switch installed in another vacuum vessel in the switch block;

a bus electrically connected with the vacuum main switch and installed in the bus block; and a cable electrically connected with the vacuum main switch and installed in the cable block, wherein the switch block accommodates the vacuum main switch and an operating device for the switches.

2. A vacuum insulated switchgear comprising:

an enclosure comprising a switch block, a bus block positioned above the switch block, and a cable block positioned beside the switch block at a rear side of the enclosure, the switch block, bus block, and cable block being partitioned from each other with grounded metal plates;

a vacuum double-break three-position switch, an earthing switch and an operating device for the switches, installed in the switch block, the vacuum double-break three-position switch being installed in one vacuum vessel and the earthing switch being installed in another vacuum vessel;

a low voltage control block positioned above the switch block at the front side of the enclosure;

a bus electrically connected with the vacuum double-break three-position switch and installed in the bus block; and a cable electrically connected with the vacuum double-break three-position switch and installed in the cable block, wherein the switch block accommodates the vacuum double-break three-position switch, the earthing switch and the operating device, has a door at the front side, and is positioned below the intermediate portion of the enclosure in the direction of height.

3. The vacuum insulated switchgear of claim 2, wherein at the front side of the door, there are disposed from top down an alarm display section for displaying an anomaly and the like in each device, an operating switch section for each device, and an emergency manual handle operating section operable in an emergency.

4. The vacuum insulated switchgear of claim 2, wherein the cable block further has therein a protection fuse and a voltage transformer connected to the cable, and wherein the protection fuse and the voltage transformer are disposed either at the upper part or at the lower part in the cable block.

5. The vacuum insulated switchgear according to claim 2, which further comprises a lever mechanism coupling together the vacuum double-break three-position switch and the operating device.

6. The vacuum insulated switchgear of any of claim 2, wherein the operating device is an electromagnetically driven operating device.

7. A vacuum insulated switchgear comprising:

an enclosure comprising a switch block, a bus block positioned adjacent to the switch block, a cable block positioned beside the switch block, and a low voltage control block positioned above the switch block at a front side of the enclosure, the blocks being partitioned from each other with grounded metal plates;

a vacuum double-break three-position switch installed in a vacuum vessel in the switch block and having a pair of fixed contacts and a pair of movable contacts;

an earthing switch disposed in another vacuum vessel in the switch block;

a bus electrically connected with the vacuum double-break three-position switch and installed in the bus block; and a cable electrically connected with the vacuum double-break three-position switch and installed in the cable block, the cable block being positioned at a rear side of the enclosure;

wherein the switch block accommodates the vacuum double-break three-position switch, the earthing switch and an operating device for the switches.

8. A vacuum insulated switchgear comprising:

an enclosure having a switch block, a bus block positioned above the switch block, a cable block positioned beside the switch block at a rear side of the enclosure, and a low voltage control block positioned above the switch block at a front side of the enclosure, the blocks being partitioned from each other with grounded metal plates;

a vacuum double-break three-position switch having opening/closing and isolating functions, disposed in a single vacuum vessel of the switch block, wherein a pair of movable contacts thereof are connected with a reinforced operation conductor connected to an operating rod;

a vacuum earthing switch disposed in another vacuum vessel in the switch block;

a bus installed in the bus block and connected to a pair of fixed contacts of the vacuum double-break three-position switch;

an electromagnetically driven operating device installed in the switch block, positioned below the vacuum double-break three-position switch and the vacuum earthing switch; and a lever mechanism coupling together individual movable contacts of the vacuum double-break three-position switch and the vacuum earthing switch, and the electromagnetically driven operating device.

9. The vacuum insulated switchgear of claim 8, wherein at the front side of the door, there are disposed from top down an alarm display section for displaying an anomaly and the like in the each device, an operating switch section for each device, and an emergency manual handle operating section operable in an emergency.

10. The vacuum insulated switchgear of claim 8, wherein in the cable block, at least one cable is connected to said fixed contacts of the vacuum double-break three-position switch and the vacuum earthing switch through a current transformer for system protection, and is connected via a T-shaped cable head, which is rotatably connected to the cable head so that the cable can be led out to above or below the enclosure.

11. The vacuum insulated switchgear of claim 10, wherein a protection fuse and a voltage transformer connected to the cable are disposed at the upper part or the lower part in the cable block.

* * * * *